US006497584B1

(12) United States Patent
Murakami et al.

(10) Patent No.: US 6,497,584 B1
(45) Date of Patent: Dec. 24, 2002

(54) HALF-FITTING PREVENTION CONNECTOR

(75) Inventors: Takao Murakami, Shizuoka (JP); Masaru Fukuda, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 46 days.

(21) Appl. No.: 09/660,486

(22) Filed: Sep. 12, 2000

(30) Foreign Application Priority Data

Sep. 20, 1999 (JP) ..... 11-265828

(51) Int. Cl.[7] ..... H01R 13/627
(52) U.S. Cl. ..... 439/352; 439/489
(58) Field of Search ..... 439/350–358, 439/159, 488, 489

(56) References Cited

U.S. PATENT DOCUMENTS 5,749,747 A * 5/1998 Inaba et al. ..... 439/358
5,820,399 A * 10/1998 Shirouzu et al. ..... 439/352
5,820,400 A 10/1998 Yamanashi et al.
5,848,912 A * 12/1998 Okabe ..... 439/489
5,938,466 A 8/1999 Suzuki et al. ..... 439/352
6,036,524 A 4/2000 Suzuki et al. ..... 439/354
6,102,726 A * 8/2000 Tsuji et al. ..... 439/352

FOREIGN PATENT DOCUMENTS

EP 0 758 150 A2 12/1997
EP 1 001 500 A1 5/2000 ..... H01R/13/635
JP 9-55261 2/1997 ..... H01R/13/64

* cited by examiner

*Primary Examiner*—Hien Vu
(74) *Attorney, Agent, or Firm*—Sughrue Mion, PLLC

(57) ABSTRACT

A half-fitting prevention connector (1) includes a pair of male and female connectors (2, 3) which are fittable to each other. A spring member (5) is received in the male connector (2) and prevents a half-fitted condition of the male and female connectors due to a resilient force thereof. A lock arm (10) is elastically and displaceably connected to a housing of one of the male and female connectors by interconnecting portions (30). The sum of the transverse cross-sectional areas of the interconnecting portions (30) is smaller than the transverse cross-sectional area of the lock arm (10) so that the entire lock arm (10) is not elastically deformed when canceling a fitted condition of the male and female connectors. When the male and female connectors are completely fitted to each other, the spring member (5) urges the lock arm (10) in such a direction that the lock arm (10) can retain the mating connector (3).

3 Claims, 9 Drawing Sheets

HALF-FITTING PREVENTION CONNECTOR

BACKGROUND OF THE INVENTION

1. Field of the Invention

The present invention relates to a half-fitting prevention connector in which a half-fitted condition is positively prevented by a resilient force of a spring member mounted in a housing of at least one of a pair of male and female connectors to be fittingly connected together, and the connector can be positively locked to the mating connector in a fitted condition.

The present application is based on Japanese Patent Application No. Hei. 11-265828, which is incorporated herein by reference.

2. Description of the Related Art

Various half-fitting prevention connectors are already known. For example, Unexamined Japanese Patent Publication No. Hei. 9-55261 discloses a half-fitting prevention connector shown in FIGS. 8 to 13.

As shown in FIG. 8, a male connector 50 includes a hood 51 having a spring receiving chamber 52 therein, and a spring 70, bent into a zigzag shape, is received in this spring receiving chamber 52 so as to be contracted. Guide portions 53*a* are formed respectively on opposed inner surfaces of a pair of guide walls 53 extending from an inner surface of a top wall of the hood 51.

And besides, in such a half-fitting prevention connector, when canceling the fitted condition, the entire elastic arm 61 needs to be elastically deformed or flexed at a region adjacent to the upstanding proximal end portion thereof, and therefore a large canceling force was required.

Connection terminals are received in terminal receiving chambers in the male connector 50, and connection terminals are also received in terminal receiving chambers in the female connector 60, each of these connection terminals being press-connected to a distal end of a wire. When the two connectors are fittingly connected together, the connection terminals in the male connector are electrically connected respectively to the connection terminals in the female connector.

In the above half-fitting prevention connector in a condition shown in FIG. 9, when the female connector 60 is inserted into the male connector 50, the guide projections 61*b*, formed respectively on the opposite side edges of the elastic arm 61, slide over the upper surfaces of the guide portions 53*a*, respectively. At this time, even if the lower end of the elastic arm 61 is pressed down, the guide projections 61*b* slide over the upper surfaces of the guide portions 53*a*, respectively, and will not come under the guide portions 53*a*, respectively, as shown in FIG. 10.

When the guide projections 61*b* thus slide respectively over the upper surfaces of the guide portions 53*a*, so that the rear end of the elastic arm 61 is raised as shown in FIG. 11, the retaining projection 61*a* enters the spring receiving chamber 52 through a communication window 52*a* formed in an upper portion of the male connector 50. Then, when the female connector 60 is further pushed into the male connector 50, the retaining projection 61*a* abuts against a front end of the spring 70 to compress the same. At this time, the resilient force of the spring 70 tends to push the female connector 60 back, and therefore when the female connector 60 ceases to be pushed in a half-fitted condition, the female connector 60 is pushed out of the male connector 50.

Then, the guide projections 61*b* pass the guide portions 53*a*, respectively, and are retained respectively by these guide portions 53*a*, so that a completely-fitted condition is achieved as shown in FIG. 13. As a result, the elastic arm 61 is restored into an initial horizontal condition, so that the retaining of the spring 70 by the retaining projection 61*a* is canceled.

For canceling the fitted condition of the male and female connectors, the rear end of the elastic arm 61 is pressed down to thereby cancel the retaining of the guide projections 61*b* by the guide portions 53*a*, as shown in FIG. 14, and the guide projections 61*b* are disposed under the guide portions 53*a*, respectively. Then, as the female connector 60 is withdrawn, the guide projections 61*b* are further pressed down by the lower surfaces of the guide portions 53*a*, respectively, so that the elastic arm 61 is elastically deformed into a bow-like shape. Then, when the female connector 60 is further withdrawn, the guide projections 61*b* pass the lower surfaces of the guide portions 53*a*, respectively, so that the fitted condition of the male and female connectors is canceled.

In the above half-fitting prevention connector, the elastic arm 61 first extends upwardly from the front end of the housing of the female connector 60, and then extends horizontally toward the rear end of the housing. The elastic arm 61 has a generally uniform thickness over the entire length thereof including the upstanding proximal end portion thereof and the horizontal portion thereof, and when canceling the fitted condition, the horizontal portion is flexed or elastically deformed into a bow-like shape.

However, as a result of repeating the connector fitting operation and the connector disengaging operation, the elastic arm 61 was liable to be plastically deformed, with the lower end thereof kept depressed, as shown in FIG. 10. With such deformed elastic arm 61, the locked condition, achieved by the guide portions 53*a* in the completely-fitted condition, was inadequate, and therefore there was a possibility that the male and female connectors were accidentally disengaged from each other upon application of an external force such as vibrations.

And besides, in such a half-fitting prevention connector, when canceling the fitted condition, the whole of the elastic arm 61 need to be elastically deformed or flexed at a region adjacent to the upstanding proximal end portion thereof, and therefore a large canceling force was required.

SUMMARY OF THE INVENTION

With the above problems in view, it is an object of the present invention to provide a half-fitting prevention connector in which a fitted condition can be positively maintained, and a fitted condition-canceling operation can be easily effected.

To achieve the above object, according to the present invention, a transverse cross-sectional area of an interconnecting portion, connecting a lock arm to a housing, is smaller than a transverse cross-sectional area of the lock arm, and the elastic deformation of the lock arm is absorbed only by the elastic deformation of the interconnecting portion so as to prevent the plastic deformation of the lock arm, and the lock arm is urged by the spring member in a direction opposite to the direction of elastic deformation of the lock arm, thereby maintaining a locked condition of the connector housings fitted to each other.

More specifically, first, second and third aspects of the present invention will now be described below.

In the first aspect of the present invention, there is provided a half-fitting prevention connector which comprises a pair of connector housings fittable to each other, a spring member receivable in one of the connector housings, the spring member being operative to prevent a half-fitted condition of the connector housings by a resilient force thereof, an interconnecting portion, and a lock arm elastically-displaceably supported on one of the connector housings through the interconnecting portion, wherein when the connector housings are completely fitted to each other, the spring member urges the lock arm in a direction in which the lock arm retains the other one of the connector housings. Here, a transverse cross-sectional area of the interconnecting portion is smaller than a transverse cross-sectional area of the lock arm so that only the interconnecting portion can be elastically deformed when canceling a fitted condition of the connector housings.

In the second aspect of the present invention, it is preferable that the lock arm extends in a direction in which one of the connector housings is fitted to the other one of the connector housings, wherein the spring member is contractibly held on the lock arm, and has a portion extending in an extending direction of the lock arm. Further, preferably, the half-fitting prevention connector further comprises an engagement portion formed on the other one of the connector housings, the engagement portion retaining the lock arm when the connector housings are completely fitted to each other, and a pressing portion formed on the other one of the connector housings, the pressing portion abutting against the spring member to compress the spring member when the lock arm is elastically displaced by the engagement portion.

In the third aspect of the present invention, it is preferable that the spring member includes a resiliently-bendable portion which is resiliently deformed to urge the lock arm in accordance with an elastic displacement of the lock arm.

Here, the term "transverse cross-sectional area of the lock arm" means the area of the cross-section of the lock arm obtained by cutting the lock arm in a direction perpendicular to a direction extending from the free end of the lock arm toward the proximal end thereof connected to the interconnecting portion. The term "transverse cross-sectional area of the interconnecting portion" means the area of the cross-section of the interconnecting portion obtained by cutting the interconnecting portion in a direction perpendicular to a direction extending from one side of the interconnecting portion, connected to the lock arm, toward the other side thereof connected to the housing. The transverse cross-sectional shape of the lock arm, as well as the transverse cross-sectional shape of the interconnecting portion, is not limited, but it is preferred that the maximum value of the transverse cross-sectional area of the interconnecting portion be smaller than the minimum value of the transverse cross-sectional area of the lock arm.

In the half-fitting prevention connector of the above construction, the elastic deformation of the whole lock arm is absorbed only by the elastic deformation of the interconnecting portion, so that the lock arm can be prevented from being plastically deformed. And besides, the lock arm is urged by the spring member in the direction opposite to the direction of elastic displacement of this lock arm, and therefore the entire lock arm will not be elastically deformed, so that the completely-fitted condition can be positively maintained. Furthermore, the increase of the canceling force by the spring member is canceled by increasing the elastic force of the interconnecting portion, and therefore the fitted condition-canceling operation can be effected efficiently.

DETAILED DESCRIPTION OF THE PREFERRED EMBODIMENT

Figure 1:
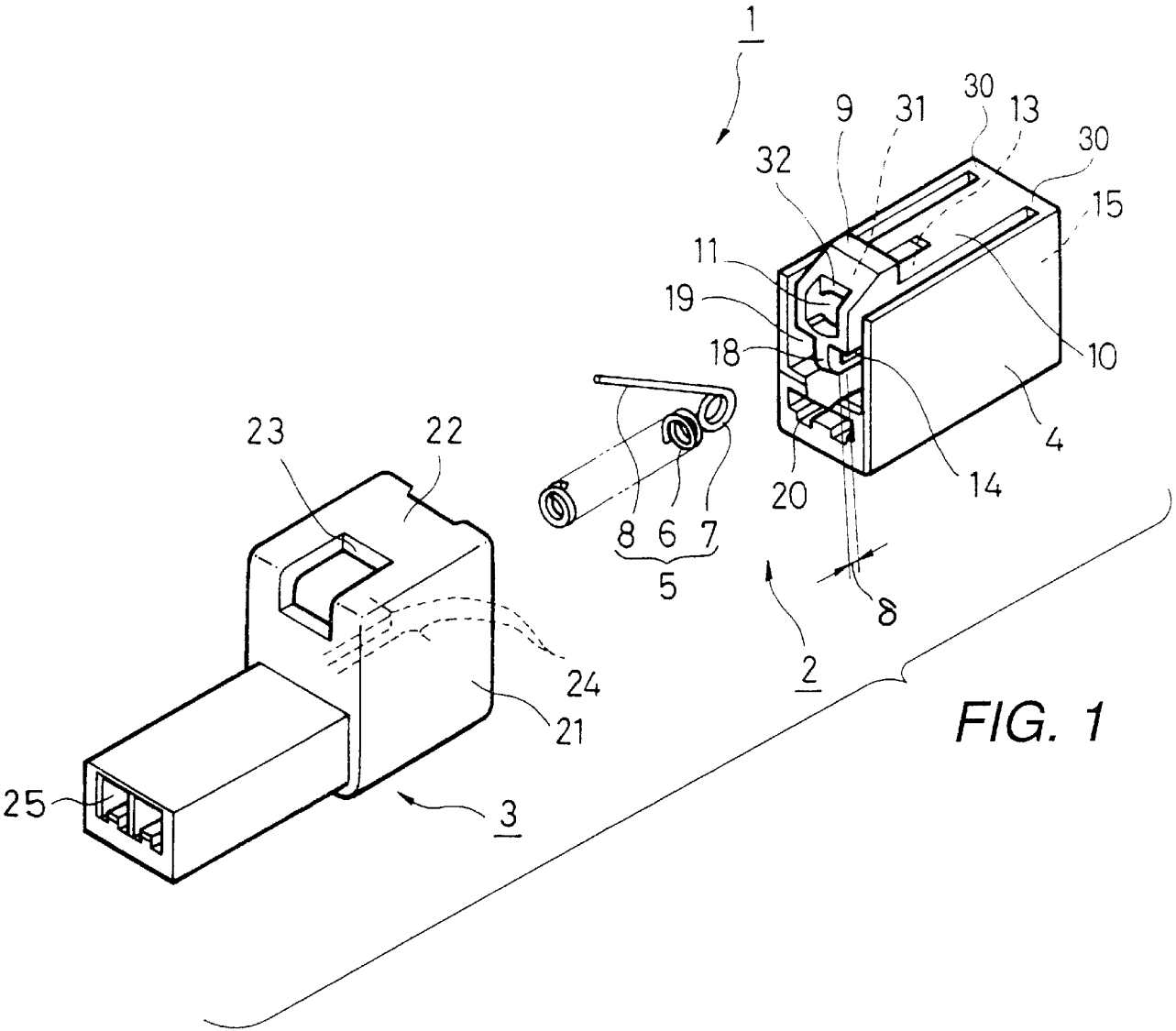
FIG. 1 is an exploded, perspective view of one preferred embodiment of a half-fitting prevention connector of the present invention.
Figure 4:
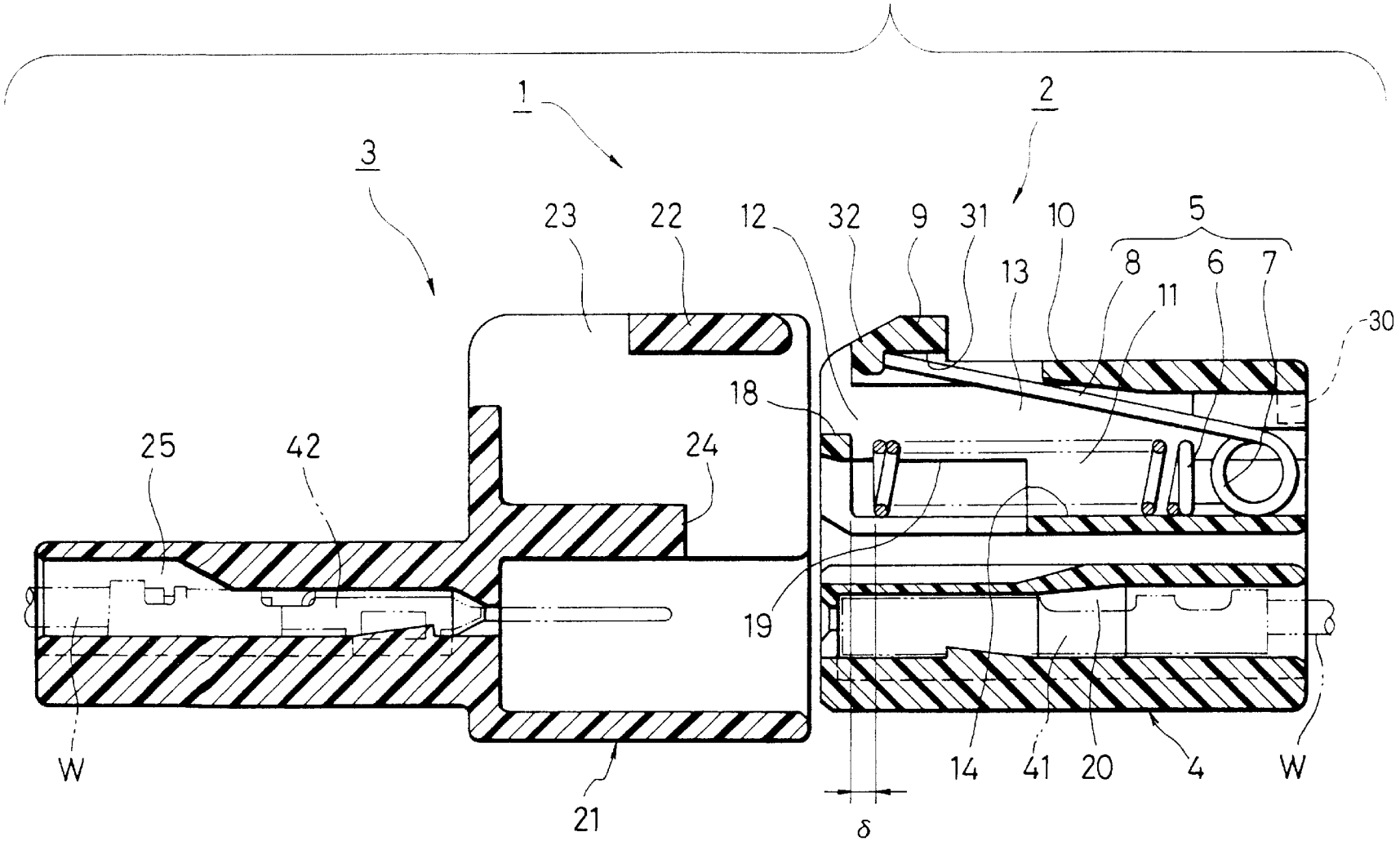
FIG. 4 is a cross-sectional view of the connector of FIG. 1, showing a condition before a fitting operation is started.
Figure 5:
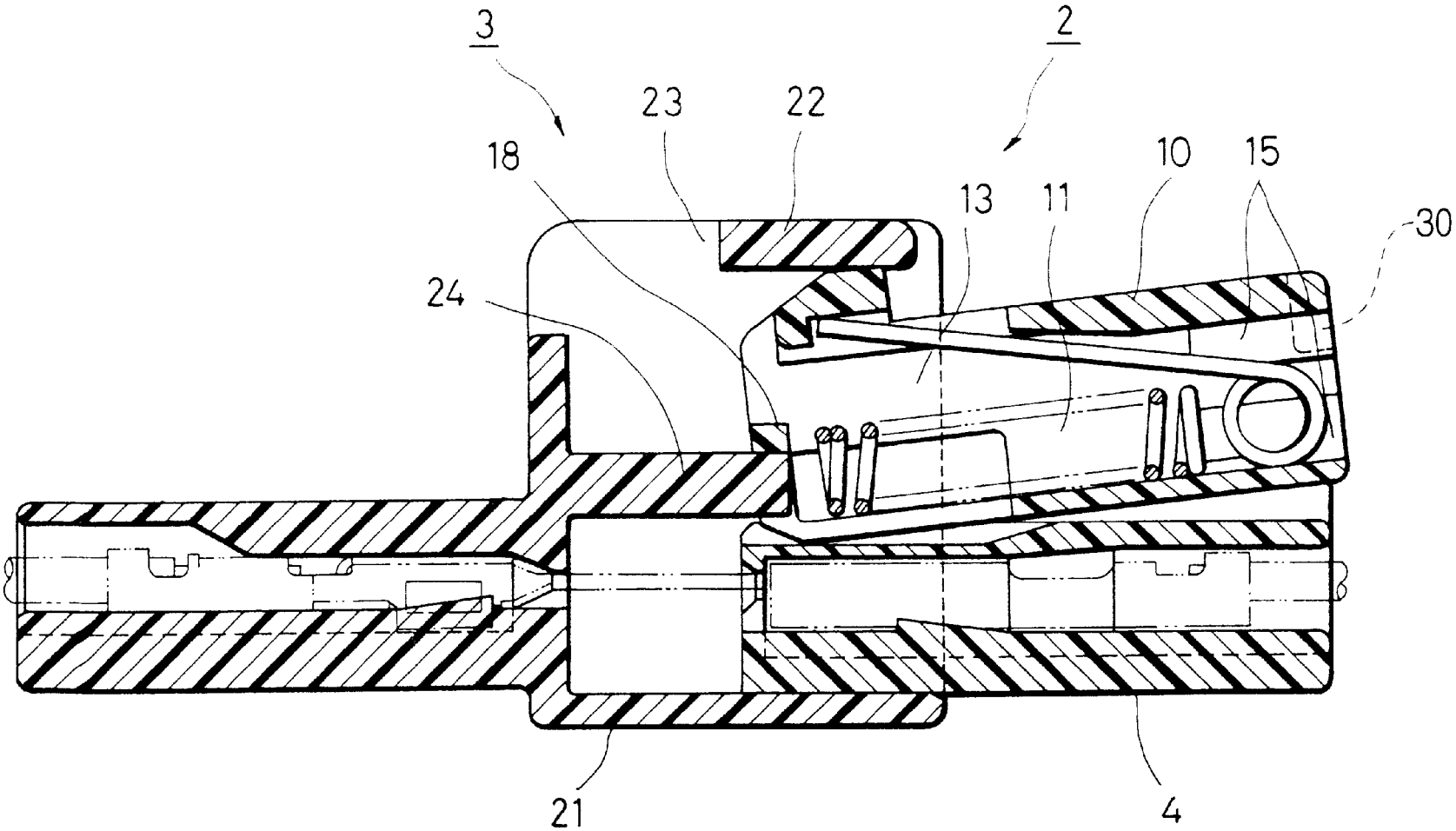
FIG. 5 is a view showing the connector of FIG. 1 at an initial stage of the fitting operation.
Figure 6:
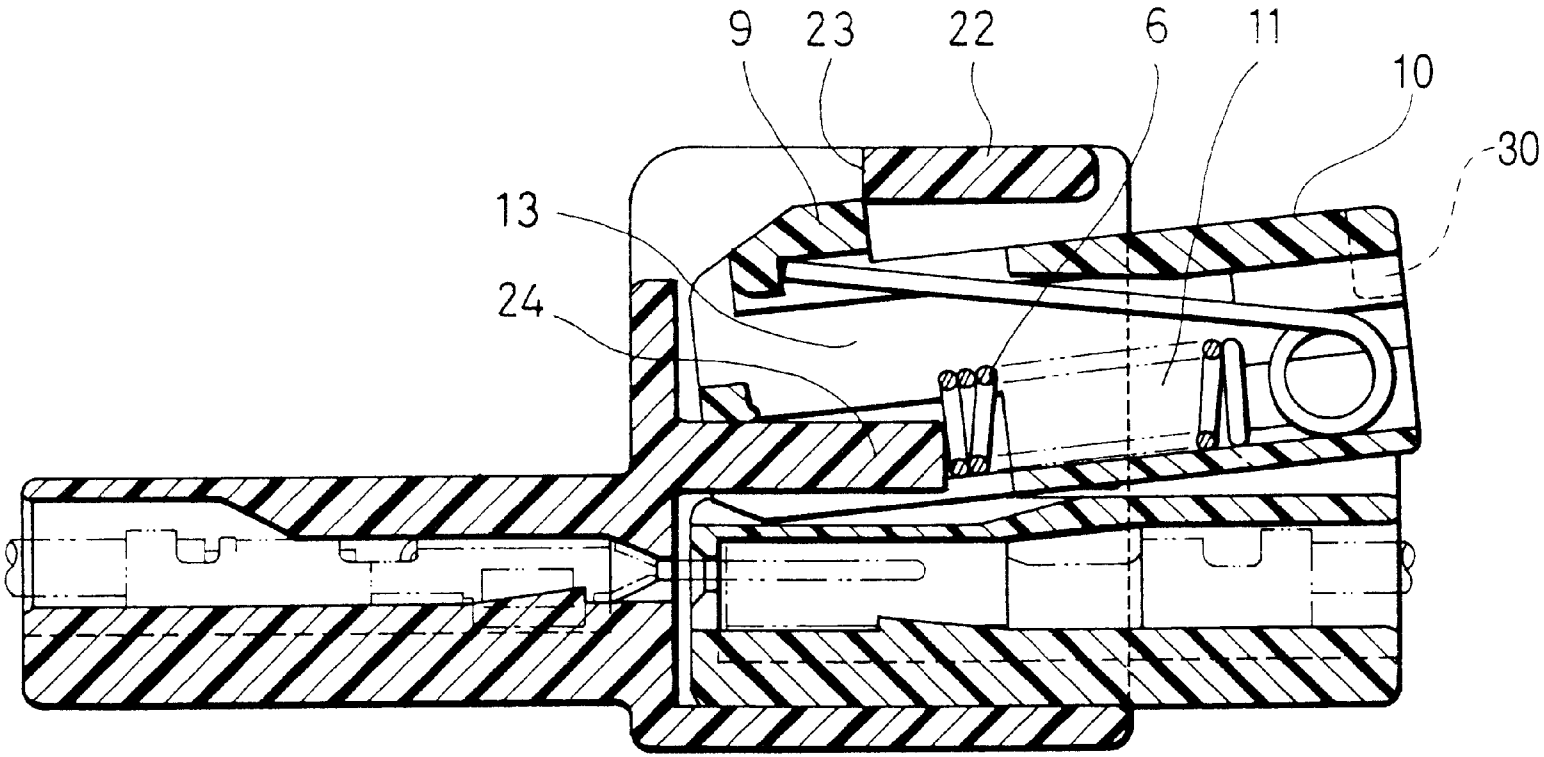
FIG. 6 is a view showing a final stage of a half-fitted condition of the connector of FIG. 1.
Figure 7:
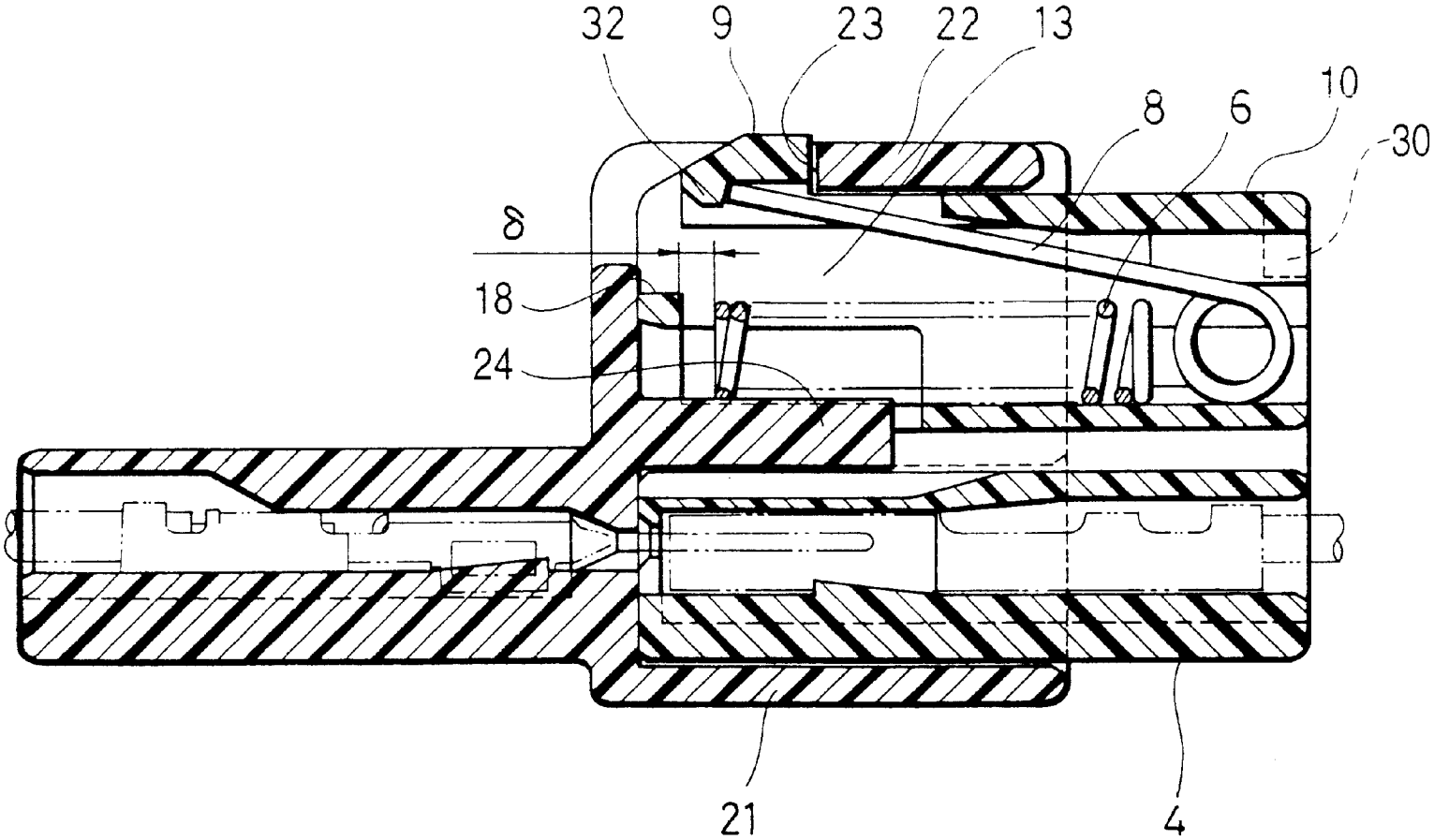
FIG. 7 is a cross-sectional view of the connector of FIG. 1 in a completely-fitted condition.
Figure 8:
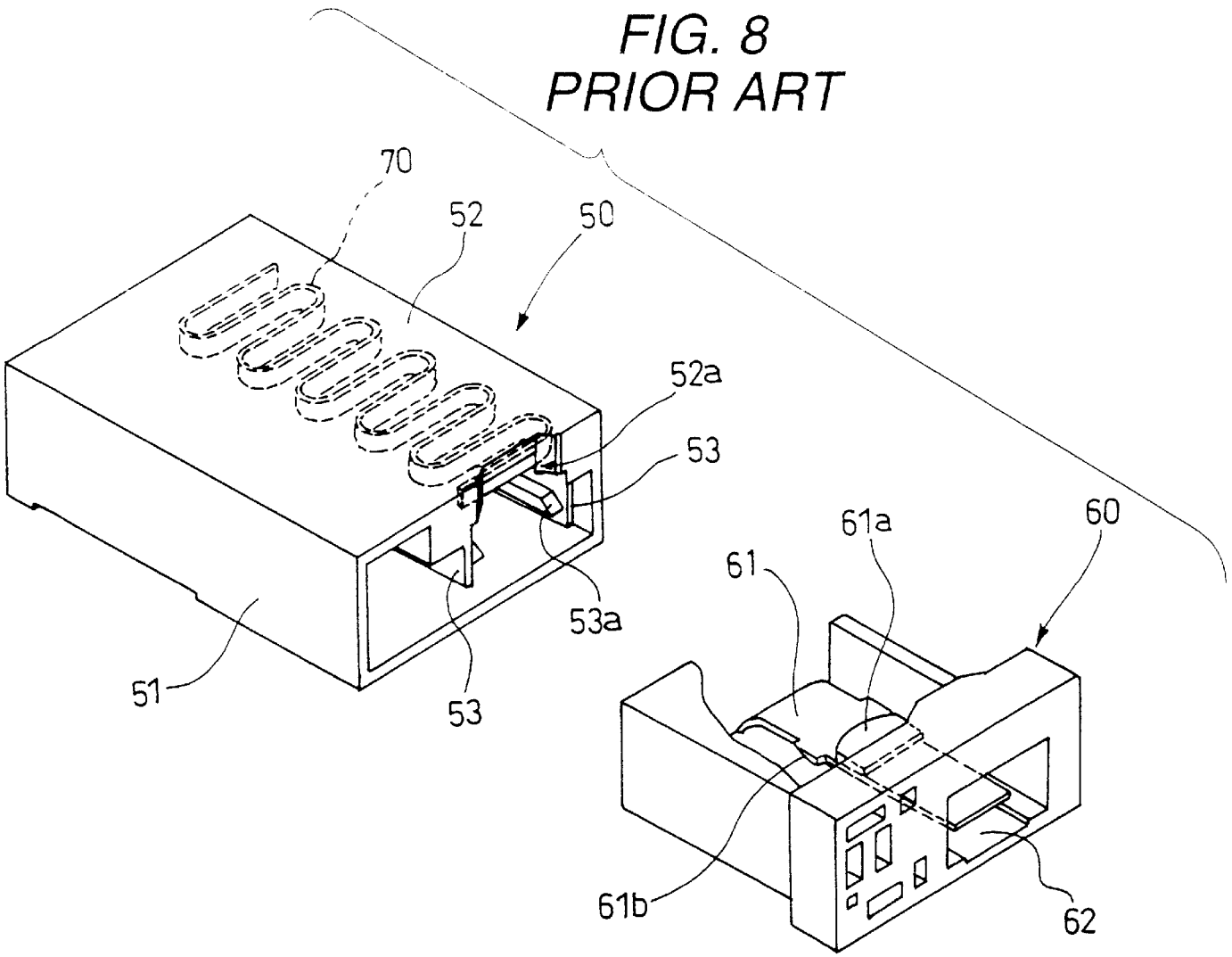
FIG. 8 PRIOR ART
FIG. 8 is an exploded, perspective view of a conventional half-fitting prevention connector.
Figure 9:
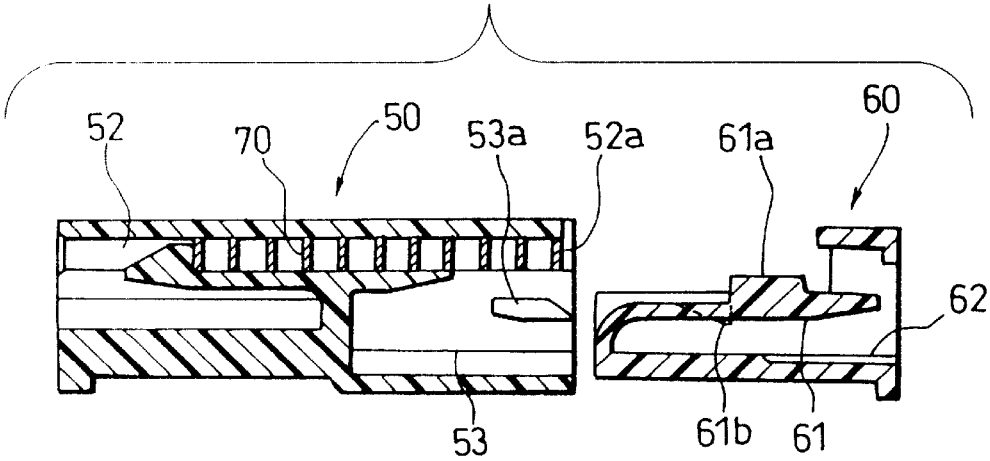
FIG. 9 PRIOR ART
FIG. 9 is a view showing the operation of male and female connectors of FIG. 8.
Figure 10:
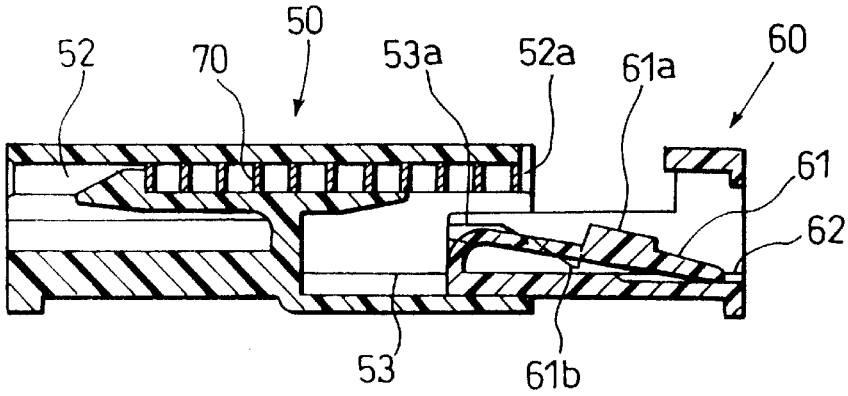
FIG. 10 PRIOR ART
FIG. 10 is a view showing the operation of the male and female connectors of FIG. 8.
Figure 11:
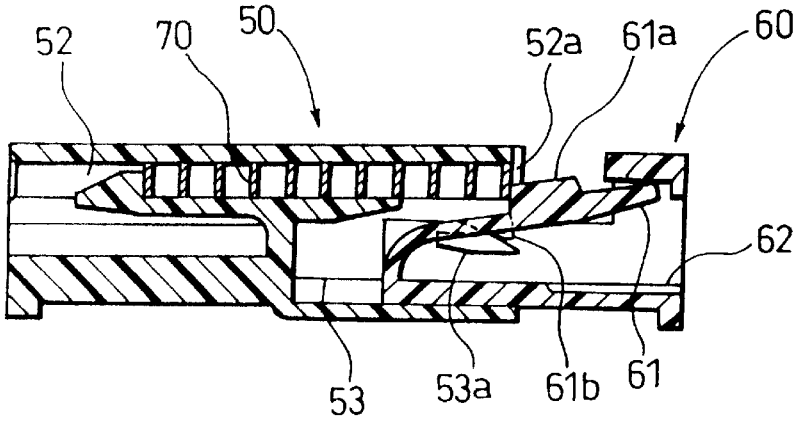
FIG. 11 PRIOR ART
FIG. 11 is a view showing the operation of the male and female connectors of FIG. 8.
Figure 12:
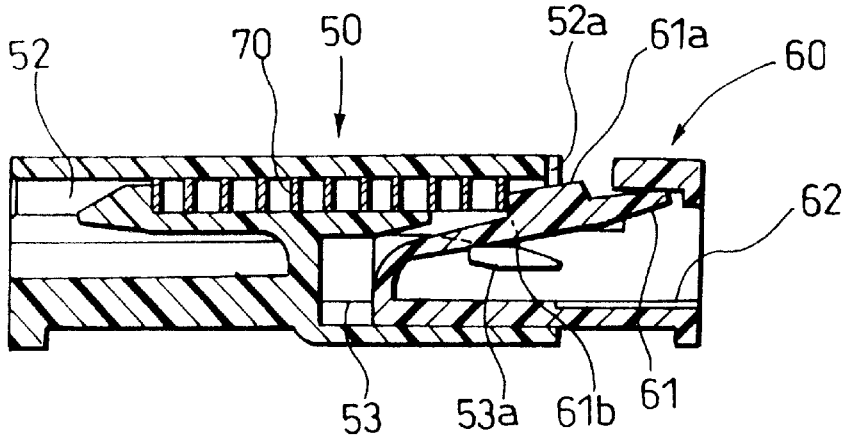
FIG. 12 PRIOR ART
FIG. 12 is a view showing the operation of the male and female connectors of FIG. 8.
Figure 13:
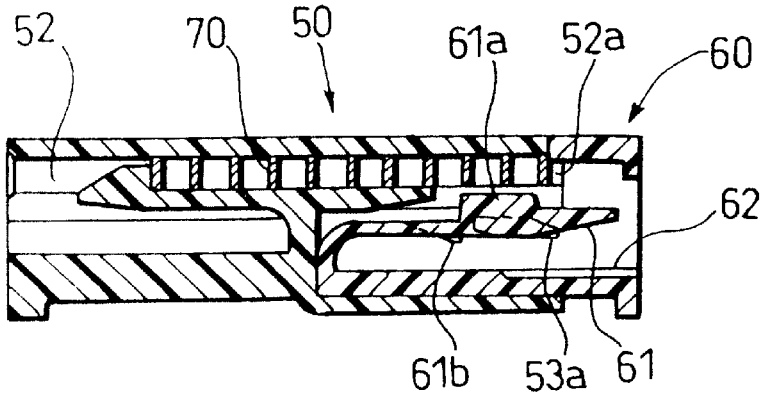
FIG. 13 PRIOR ART
FIG. 13 is a view showing the operation of the male and female connectors of FIG. 8.
Figure 14:
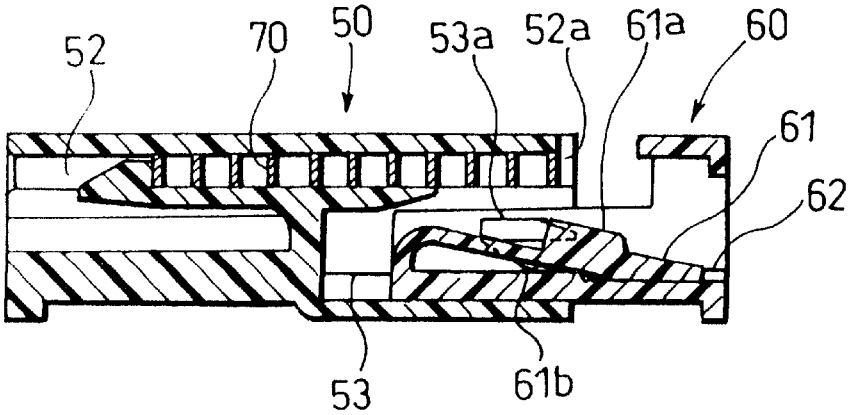
FIG. 14 PRIOR ART
FIG. 14 is a view showing the operation of the male and female connectors of FIG. 8.

One preferred embodiment of a half-fitting prevention connector of the present invention will now be described in detail with reference to FIGS. 1 to 7. FIG. 1 is an exploded, perspective view of the half-fitting prevention connector, FIG. 2 is a cross-sectional view of a housing of a male connector of FIG. 1, FIG. 3 is a cross-sectional view taken along the line III—III of FIG. 2, FIG. 4 is a cross-sectional view of the connector of FIG. 1, showing a condition before a fitting operation is started, FIG. 5 is a view showing the connector of FIG. 1 at an initial stage of the fitting operation, FIG. 6 is a view showing a final stage of a half-fitted condition of the connector of FIG. 1, and FIG. 7 is a cross-sectional view of the connector of FIG. 1 in a completely-fitted condition.

As shown in FIGS. 1 to 4, in the half-fitting prevention connector 1 of this embodiment, a half-fitted condition of a pair of male and female connectors 2 and 3 to be fitted together is prevented by a resilient force of a spring member 5 received in a housing 4 of the male connector 2. A lock arm 10, having an engagement projection 9 for retaining the female connector 3, is elastically-displaceably supported on the housing 4 of the male connector 2 through interconnecting portions 30.

Figure 2:
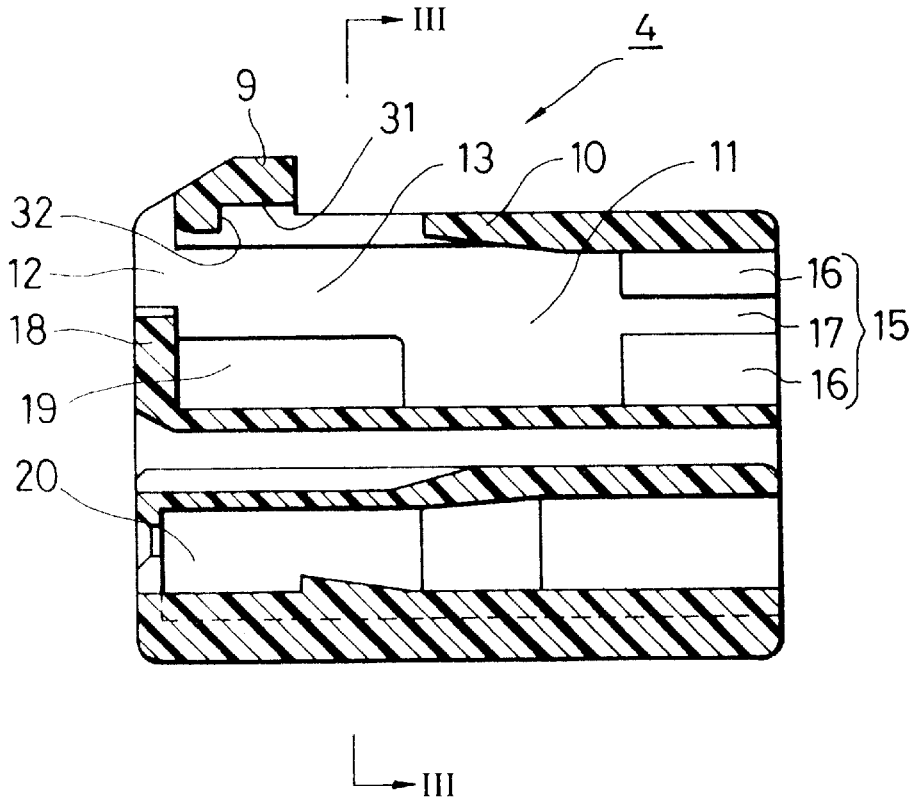
FIG. 2 is a cross-sectional view of a housing of a male connector of FIG. 1.

As shown in FIGS. 1 and 2, a receiving chamber 11 is formed within the lock arm 10, and this receiving chamber 11 includes an insertion port 12 for the spring member 5, a movement-enabling space 13 for enabling the movement of the spring member 5, and a bottom 14. A front holding portion 18 is formed at a front end of the receiving chamber 11 in an upstanding manner. A lower portion of the front end portion of the receiving chamber 11 is made open at opposite sides thereof by notches 19, and a pair of pressing projections 24 on the female connector 3 (described later) can enter these notches 19, respectively. Terminal receiving chambers 20 are formed in a lower portion of the housing 4 disposed below the receiving chamber 11.

Figure 3:
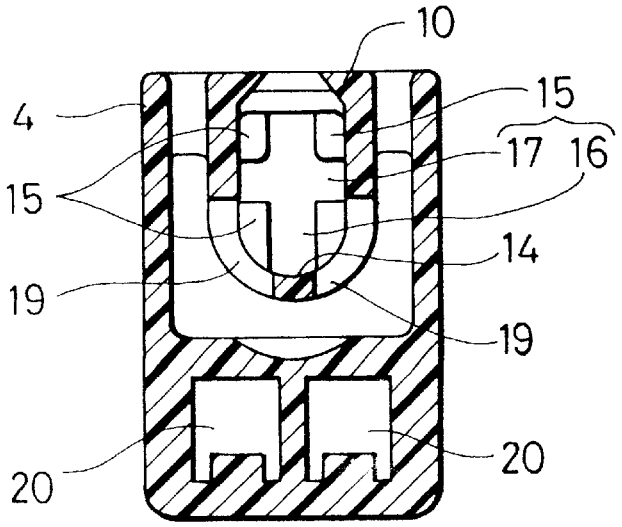
FIG. 3 is a cross-sectional view taken along the line III—III of FIG. 2.

As shown in FIG. 3, a rear holding portion 15 is formed at a rear end of the receiving chamber 11, and a vertical groove 16 and a horizontal groove 17 are formed in this rear holding portion 15 in intersecting relation to each other. This rear holding portion 15 serves to hold the spring member 5 in a predetermined direction.

As shown in FIG. 1, the female connector 3 includes a housing 21 for fitting on the housing 4, and an engagement plate 22 and an engagement window 23 for engagement with the engagement projection 9, which are provided at an upper portion of this housing 21. The pair of pressing projections 24 are provided within the housing 21, and project forwardly. When the lock arm 10 is elastically displaced during the fitting operation, the pressing projections 24 abut against the front end of the spring member 5 to compress the same. Terminal receiving chambers 25 are provided at a rear portion of the housing 21, and extend rearwardly.

The spring member 5 includes a coil-shaped compression spring portion 6, and a rear end portion of this compression spring portion 6 is twisted perpendicularly to an axis thereof to form a torsion spring portion 7, and a resiliently-bendable portion 8 extends obliquely forwardly from the torsion spring portion 7.

The spring member 5 is held between the rear holding portion 15 and the front holding portion 18 within the receiving chamber 11 in the male connector 2, and a gap δ is formed between the front end of the spring member 5, disposed in a free condition, and the front holding portion 18, as shown in FIG. 4. An abutment portion 31 is formed at the reverse surface (inner surface) of the engagement projection 9, and a distal end of the resiliently-bendable portion 8 is held against this abutment portion 31. A retaining portion 32, which retains the front end of the resiliently-bendable portion 8, is formed at a front end of the abutment portion 31.

As s hown in FIG. 4, the pair of interconnecting portions 30 are forme d on and project respectively from the opposite side surfaces of the lock arm 10 at the rear end thereof, and connect the lock arm 10 to the housing, each of the two interconnecting portions 30 having a rectangular transverse cross-section. The sum of the transverse cross-sectional areas of the pair of interconnecting portions 30 is smaller than the transverse cross-sectional area (areas of the lock arm 10 indicated by hatching) of the lock arm 10 shown in FIG. 3.

For assembling the half-fitting prevention connector 1, first, the spring member 5 is inserted into the receiving chamber 11 through the insertion port 12 in the lock arm 10 of the housing 4, with the resiliently-bendable portion 8 directed upwardly, as shown in FIG. 4. As a result, the torsion spring portion 7 is held in the vertical groove 16 in the rear holding portion 15, and the distal end of the resiliently-bendable portion 8 is held against the abutment portion 31, and is retained by the retaining portion 32. By the resilient force of the resiliently-bendable portion 8, the compression spring portion 6 is moved downwardly from the movement-enabling space 13, and is pressed against the bottom 14 in a stable condition. Female terminals 41, each connected to a sheathed wire W, are inserted respectively into the terminal receiving chambers 20 from the rear side, and are retained in position by respective lances or the like.

Also, male terminals 42, each connected to a sheathed wire W, are inserted respectively into the terminal receiving chambers 25 provided at the rear portion of the housing 21, and are retained in position by respective lances or the like.

Next, the fitting operation will be described with reference to FIGS. 4 to 7. First, the male and female connectors 2 and 3 are opposed to each other as shown in FIG. 4, and then are pushed relative to each other in a fitting direction. As a result, a slanting surface at the front end of the engagement projection 9 abuts against the inner surface of the engagement plate 22, so that the lock arm 10 is elastically displaced downwardly together with the spring member 5, as shown in FIG. 5. At this time, although the interconnecting portions 30 are elastically deformed, the lock arm 10 is not elastically deformed into a bow-like shape, but remains in a straight shape.

When the fitting operation further proceeds, the front end of the compression spring portion 6 abuts against the front ends of the pressing projections 24 as shown in FIG. 6, so that the compression spring portion 6 is compressed, and therefore its resilient force, acting in an anti-fitting direction, gradually increases. This process proceeds immediately before the engagement projection 9 is disengaged from the inner surface of the engagement plate 22. This condition is a final stage of a half-fitted condition, and when the application of the fitting force is canceled before this stage, the female connector 3 is pushed back or returned by the resilient force of the compression spring portion 6, thereby preventing the half-fitting connection.

Then, when the fitting operation further proceeds from the final stage of the half-fitted condition, the engagement projection 9 projects into the engagement window 23, and simultaneously with this, the engagement projection 9 is retained by the engagement plate 22, as shown in FIG. 7. As a result, the elastically-displaced lock arm 10 is restored into its original condition, so that a completely-fitted condition is achieved. The front end of the compression spring portion 6 is disengaged from the front ends of the pressing projections 24, and is restored into a free condition. However, the gap δ is formed between the front end of the compression spring portion 6 and the front holding portion 18, and besides the spring member 5 is retained in the rear position by the resiliently-bendable portion 8 and the retaining portion 32, and therefore the spring vibration of the compression spring portion 6 is attenuated in the gap δ, so that the housing 4 will not be damaged by the resilient force of the compression spring portion 6.

For canceling the completely-fitted condition of FIG. 7, the housings 4 and 21 of the male and female connectors 2 and 3 are held with the hands, respectively, and are moved away from each other while pressing the engagement projection 9 with the finger. As a result, this operation proceeds in a manner reverse to that described above for the fitting operation, and the completely-fitted condition is canceled. However, when the lock arm 10 is elastically displaced downwardly, the front portion of the compression spring portion 6 remains supported on the pressing projections 24 of the female connector 3, and therefore the compression spring portion 6 inevitably moves in the movement-enabling space 13 within the receiving chamber 11. Therefore, during the fitted condition-canceling operation, the compression spring portion 6 is kept in a free, no-load condition. Thus, the resilient force of the compression spring portion 6 is not exerted, and therefore the force, required for disengaging the male connector from the female connector 3 while elastically displacing the lock arm 10, is small.

In the half-fitting prevention connector 1 of the above construction, the sum of the transverse cross-sectional areas of the interconnecting portions 30 is smaller than the transverse cross-sectional area of the lock arm 10, and the elastic deformation of the whole of the lock arm 10 is absorbed only by the elastic deformation of the interconnecting portions 30, so that the lock arm 10 can be prevented from being plastically deformed. When the completely-fitted condition is achieved, the lock arm 10 is urged by the spring member 5 in a direction opposite to the direction of elastic displacement of this lock arm 10. Therefore, the completely-fitted condition of the male and female connectors can be positively maintained. And besides, the increase of the canceling force by the spring member 5 is canceled by increasing the elastic force of the interconnecting portions 30, and therefore the fitted condition-canceling operation can be effected efficiently.

The spring member 5 includes the coil-shaped compression spring portion 6, and the rear end portion of this compression spring portion 6 is twisted perpendicularly to the axis thereof to form the torsion spring portion 7, and the resiliently-bendable portion 8 extends obliquely forwardly from the torsion spring portion 7. Therefore, when the completely-fitted condition is achieved, the lock arm is positively urged in the direction opposite to the direction of elastic displacement of this lock arm. And besides, the spring member 5 is pressed against the bottom 14 of the receiving chamber 11 by the resiliently-bendable portion 8, and therefore noises will not be produced by vibrations of a vehicle and other factors.

The present invention is not limited to the above embodiment, but suitable modifications and improvements can be made.

For example, in the above embodiment, although the female terminals 41 are received respectively in the terminal receiving chambers 20 in the male connector while the male terminals 42 are received respectively in the terminal receiving chambers 25 in the female connector, the female terminals 41 may be received in a female connector while the male terminals 42 are received in a male connector.

The spring member 5 may be replaced by a spring member which includes a compression spring portion, comprising a strip bent into a zigzag shape, a folded-back portion formed at a rear end of this compression spring portion, and a strip-like, resiliently-bendable portion extending obliquely forwardly from this folded-back portion.

As described above, in the half-fitting prevention connector of the present invention, when the two connectors are completely fitted together, the spring member urges the lock arm in such a direction that the lock arm can retain the mating connector, and the transverse cross-sectional area of the interconnecting portions is smaller than the transverse cross-sectional area of the lock arm so that the entire lock arm is not elastically deformed, but only the interconnecting portions can be elastically deformed when canceling the fitted condition of the two connectors.

Therefore, the locked condition of the two connectors, fitted together, can be positively maintained, and the fitted condition-canceling operation can be effected easily.

The lock arm is formed on the housing of the one connector, and extends in the direction of fitting of the one connector relative to the other connector, and the spring member is contractibly held on the lock arm, and extends in the direction of extending of the lock arm, and the housing of the other connector includes the engagement portion for retaining the lock arm when the two connectors are completely fitted together, and the pressing portion for abutting against the spring member to compress the same when the lock arm is elastically displaced by the engagement portion. With this construction, the locked condition of the two connectors, fitted together, can be more positively maintained without complicating the fitted condition-canceling operation.

The spring member includes the resiliently-bendable portion which is resiliently deformed in accordance with the elastic displacement of the lock arm to urge the lock arm. With this construction, when the two connectors are completely fitted together, the spring member more positively urges the lock arm in such a direction that the lock arm can retain the mating connector.

What is claimed is:

1. A half-fitting prevention connector, comprising:

a pair of connector housings fittable to each other;

a spring member receivable in one of said pair of connector housings, the spring member being operative to prevent a half-fitted condition of said pair of connector housings by a resilient force thereof;

an interconnecting portion; and a lock arm that is elastically and displaceably connected to said one of said pair of connector housings by the interconnecting portion, wherein when said pair of connector housings are completely fitted to each other, the spring member in said one of said pair of connector housings urges the lock arm in a direction in which the lock arm retains another one of said pair of connector housings, wherein a transverse cross-sectional area of the interconnecting portion is smaller than a transverse cross-sectional area of the lock arm so that only the interconnecting portion is elastically deformed when a complete fitted condition of said pair of connector housings is terminated, and wherein the spring member includes a resiliently-bendable portion which is resiliently deformed to urge the lock arm in accordance with an elastic displacement of the lock arm.

2. A half-fitting prevention connector, comprising:

a pair of connector housings fittable to each other;

a spring member receivable in one of said pair of connector housings, the spring member being operative to prevent a half-fitted condition of said pair of connector housings by a resilient force thereof;

an interconnecting portion; and a lock arm that is elastically and displaceably connected to said one of said pair of connector housings by the interconnecting portion, wherein when said pair of connector housings are completely fitted to each other, the spring member in said one of said pair of connector housings urges the lock arm in a direction in which the lock arm retains another one of said pair of connector housings, wherein a transverse cross-sectional area of the interconnecting portion is smaller than a transverse cross-sectional area of the lock arm so that only the interconnecting portion is elastically deformed when a complete fitted condition of said pair of connector housings is terminated, wherein the lock arm extends in a direction in which said one of said pair of connector housings is fitted to said another one of said pair of connector housings, wherein the spring member is contractibly held on the lock arm, and has a portion extending in an extending direction of the lock arm, and wherein the half-fitting prevention connector further comprises:

an engagement portion formed on said another one of said pair of connector housings, the engagement portion retaining the lock arm when said pair of connector housings are completely fitted to each other; and a pressing portion formed on said another one of said pair of connector housings, the pressing portion abutting against the spring member to compress the spring member when the lock arm is elastically displaced by the engagement portion.

3. The half-fitting prevention connector according to claim 2, wherein the spring member includes a resiliently-bendable portion which is resiliently deformed to urge the lock arm in accordance with an elastic displacement of the lock arm.

* * * * *